US005206483A

United States Patent [19]

Aota

[11] Patent Number: 5,206,483

[45] Date of Patent: Apr. 27, 1993

[54] TEMPERATURE CONTROLLED GLOW PLUG HAVING CONTROLLED SATURATION AND AFTERGLOW CHARACTERISTICS

[75] Inventor: Takashi Aota, Saitama, Japan

[73] Assignee: Jidosha Kiki Co., Ltd., Japan

[21] Appl. No.: 878,057

[22] Filed: May 4, 1992

[30] Foreign Application Priority Data

May 30, 1991 [JP] Japan ..... 3-048304[U]

[51] Int. Cl.[5] ..... F23Q 7/22; H05B 3/00; F02P 19/02; H01C 3/02

[52] U.S. Cl. ..... 219/270; 123/145 A; 219/539; 219/544

[58] Field of Search ..... 219/260–270, 219/552, 544, 539; 123/145 R, 145 A

[56] References Cited

U.S. PATENT DOCUMENTS 4,549,071 10/1985 Hatanaka et al. .
4,636,614 1/1987 Itoh et al. .
5,039,839 8/1991 Masaka et al. ..... 219/270
5,118,921 6/1992 Aota ..... 219/270

*Primary Examiner*—Anthony Bartis
*Attorney, Agent, or Firm*—Blakely, Sokoloff, Taylor & Zafman

[57] ABSTRACT

A sheath heater is formed by connecting first and second helical resistive elements having different positive resistance temperature coefficients in series, and incorporating the first and second resistive elements in a sheath such that the two resistive elements are embedded in a heat resistance electric insulating powder. The sheath diameter of a sheath portion in which the first resistive element is embedded is set to be smaller than that of a sheath portion in which the second resistive element is embedded. In addition, the first and second resistive elements are connected to each other, through connecting ends extending to be located within the outer diameter of the first resistive element, within a gap larger than the sheath diameter of the sheath portion in which the first resistive element is embedded.

5 Claims, 5 Drawing Sheets

TEMPERATURE CONTROLLED GLOW PLUG HAVING CONTROLLED SATURATION AND AFTERGLOW CHARACTERISTICS

BACKGROUND OF THE INVENTION

The present invention relates to a temperature self-control type glow plug and, more particu to an improvement in the glow plug disclosed in U.S. Pat. No. 5,132,516.

Glow plugs having various structures have been known as glow plugs used o improve the starting characteristics of diesel engines. The present applicant has also proposed a temperature self-control type glow plug in, e.g., Japanese Patent Laid-Open No. 57-182026, in which an inventive combination of resistive elements made of two types of materials is used to obtain not only a quick heating function but also a temperature saturation function for ensuring stable heating characteristics by preventing overheating of a heating wire.

In a glow plug of this type, a first resistive element serving as a heating element and a second resistive element connected in series with the first resistive element and made of a material having a positive resistance temperature coefficient larger than that of the first resistive element are embedded in a heat resistance electric insulating powder contained in a metal sheath. In addition, a gap is formed between the two resistive elements to delay heat transmission from the first resistive element. With this arrangement, a required high power is supplied to the first resistive element immediately after its energization to quickly generate heat, thus ensuring the quick heating characteristic. In addition, after a predetermined period of time elapses, the power supplied to the first resistive element is decreased with an increase in resistance of the second resistive element due to a temperature rise on the second resistive element side so as to prevent fusing caused by overheating of the first resistive element, thus ensuring the temperature self-saturation function. With such a structure, since an energization circuit for the glow plug need not have a temperature control means for controlling the supply power, the overall cost of a preheating device can be reduced.

Such a conventional glow plug can ensure both the quick heating function and the temperature self-saturation function to a certain degree. It is, however, difficult to realize such a heating characteristic as the heating temperature being decreased in an afterglow period after the engine is started. Although the conventional glow plug can perform an afterglow operation for about several tens seconds, it cannot satisfy a recent demand for a long-time (10 minutes or more) afterglow operation. In order to realize both the quick heating function described above and the function of performing an afterglow operation for a long period of time while decreasing the heating temperature, a relay used in a preheating period and a relay used for an afterglow period must be separately incorporated in the energization circuit for the glow plug, and at the same time, a voltage dropping resistor and the like need to be incorporated in a circuit on the afterglow side. As a result, the number of circuit components is increased to increase the cost of the overall apparatus.

In order to realize such a long-time afterglow operation by using only a glow plug without adding any elements to the circuit, the energization power to a heating element is self-controlled to greatly improve the heating characteristic, thus preventing overheating at a heater portion. In addition, for example, it is required that the glow plug have a temperature self-control function which serves to decrease the saturation temperature to a proper temperature or lower and keep the temperature so as to ensure the durability of a heating wire. Under the circumstances, there is a demand for a glow plug having a heater portion having a quick heating characteristic, a temperature self-saturation characteristic, and the like, and achieving high reliability in terms of heat resistance and the like.

In a glow plug having a sheath heater constituted by a combination of the two types of heating wires described above, in order to realize a quick heating function, a sheath tip in which a front heating wire serving as a heating portion is embedded is formed into a small-diameter portion to have a heat capacity smaller than that of a sheath portion in which a rear heating wire serving as a control portion is embedded. Such glow plugs have been proposed in, e.g., Japanese Patent Laid-Open Nos. 54-60630 and 57-87535. These conventional structures are effective to a certain degree in realizing a quick heating characteristic by supplying a high electric power to the front heating wire at the initial stage of energization to obtain a required heating temperature, but cannot provide a sufficient overshoot function which serves to decrease the heating temperature after the lapse of a predetermined period of time and perform an afterglow operation over a long period of time while ensuring the durability of the heating wire and the like. That is, the conventional structures cannot provide heating characteristics wherein heat is generated first to obtain a required temperature, and the heating temperature is decreased to a sufficiently low temperature with the lapse of time so as to be saturated. There is a demand for some measures to satisfy the above-described requirements by giving careful consideration to these points.

Especially in the above-described glow plug, the sheath heater is formed in such a manner that a heat resistance electric insulating powder is packed in a sheath containing resistive elements, and a swaging process is performed on the sheath from its outer surface side to achieve an increase in density of the sheath, while a required heat transmission and the like are obtained to improve the heating characteristics, and the reliability is ensured. In this case, however, since each component is thin and small, care must be taken to perform proper manufacturing and assembly processes. Therefore, in consideration of these problems in the manufacture, the above-described requirements need to be satisfied.

SUMMARY OF THE INVENTION

It is an object of the present invention to form a sheath heater having two types of series-connected resistive elements embedded in a heat resistance electric insulating powder in a sheath by a simple manufacturing process with high reliability.

In order to achieve the above object, according to the present invention, there is provided a temperature self-control type glow plug comprising a first helical resistive element serving as a heating element, a second helical resistive element connected in series with one end of the first helical resistive element and made of a material having a positive resistance temperature coefficient larger than that of the first helical resistive element, and a sheath enclosing the first and second helical resistive elements embedded in a heat resistant electric insulating powder, wherein a sheath diameter DR of a portion of the sheath in which the first helical resistive element is embedded is set to be smaller than a sheath diameter DB of a portion of the sheath in which the second helical resistive element is embedded, a gap larger than the sheath diameter DR of the portion in which the first helical resistive element is embedded is formed between the first and second helical resistive elements, and the two helical resistive elements are connected to each other within the gap through connecting ends respectively extending from the resistive elements to be located within an outer diameter of the first helical resistive element.

According to the present invention, the heat capacity of the heath tip in which the first resistive element serving as a heating element is embedded is set to be sufficiently smaller than that of the sheath rear end in which the second resistive element on the control side is embedded, thus realizing a quick heating function. In addition, by properly utilizing an electric power control function by means of the second resistive element on the control side, which is embedded in the sheath rear end and connected to the first resistive element, embedded in the sheath tip as a heating element embedding portion, through a predetermined gap, the overshoot characteristic can be obtained, wherein a saturation characteristic can be obtained at a temperature sufficiently lower than the peak temperature, thus allowing afterglow over a long period of time. Furthermore, since a connecting portion through which the first and second resistive elements are connected to each other is constituted by the connecting ends extending to be located within the small outer diameter of the first resistive element, the problem of a short circuit and the like are not caused when a swaging process is performed on the sheath, thereby forming a sheath heater in a required state with high reliability.

DESCRIPTION OF THE PREFERRED EMBODIMENT

Figure 1:
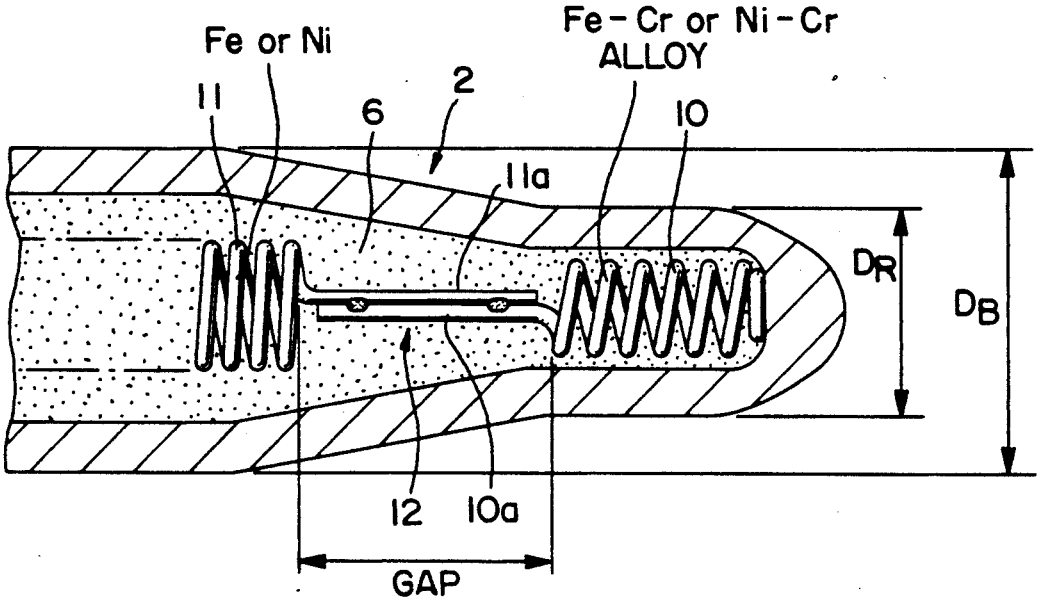
FIG. 1 is an enlarged sectional view showing only a main part of a sheath heater in a temperature self-control type glow plug according to an embodiment of the present invention.
Figure 2A:
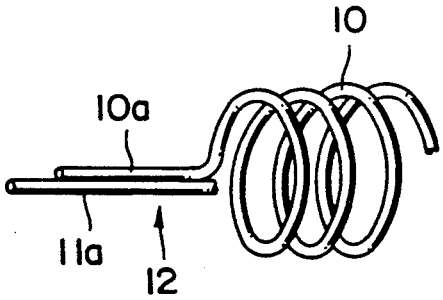
FIGS. 2(*a*) and 2(*b*) are a schematic perspective view and a side view, respectively, for explaining the structure of a connecting portion of helical resistive elements, which is a characteristic feature of the present invention.
Figure 2B:
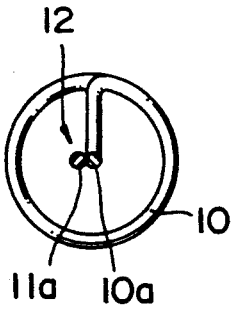
Figure 3:
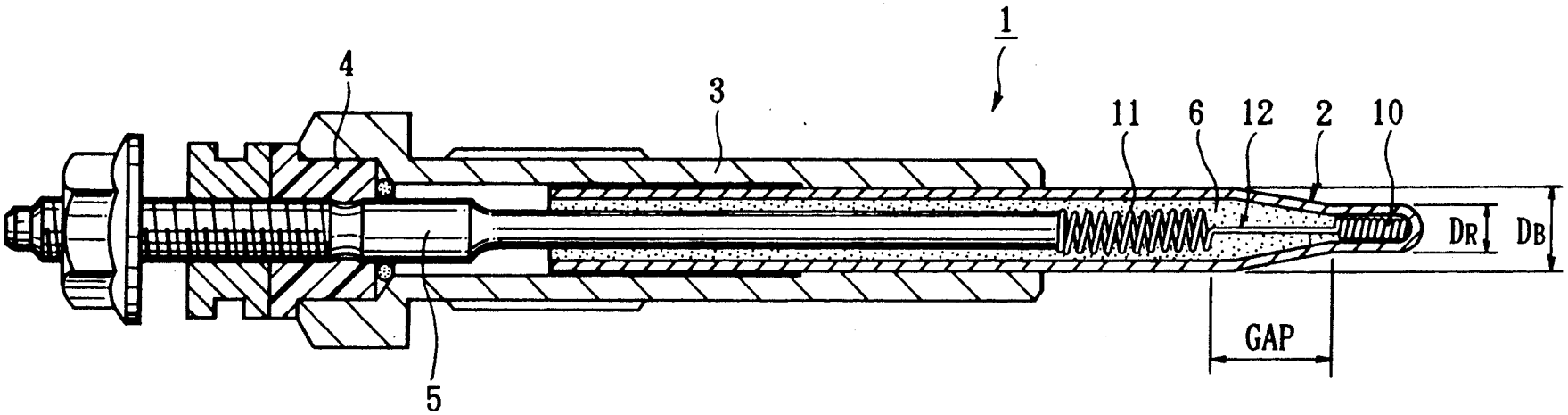
FIG. 3 is a schematic sectional view showing the overall temperature self-control type glow plug to which the present invention is applied.

FIGS. 1 to 3 show a temperature self-control type glow plug according to an embodiment of the present invention. The schematic arrangement of a glow plug denoted by reference numeral 1 as a whole will be briefly described with reference to, e.g., FIG. 3. Reference numeral 2 denotes a sheath made of a heat-resistant metal material such as stainless steel; and 3, a cylindrical housing for holding the sheath 2 at its tip. An electrode rod 5 is concentrically secured to the rear end of the housing 3 through an insulating bushing 4. The tip of the electrode rod 5 extends into the sheath 2.

In a space within the front side of the sheath 2, a first helical resistive element 10 (to be referred to as a first resistive element hereinafter) consisting of a conductive material having a small positive resistance temperature coefficient, e.g., an iron-chromium or nickel-chromium alloy, and serving as a heating element is arranged to extend in the axial direction. One end of the resistive element 10 is electrically connected to the front side of the sheath 2. In a space within the rear side of the sheath 2, a second helical resistive element 11 (to be referred to as a second resistive element hereinafter) consisting of a conductive material having a large positive resistance temperature coefficient, e.g., an iron or nickel material, is arranged between the first resistive element 10 and the electrode rod 5 on the rear side of the sheath 2 so as to be continuous with the first resistive element 10. With this arrangement, the first and second resistive elements 10 and 11 are connected in series with each other between the sheath 2 and the electrode rod 5. Note that the first and second resistive, elements, 10 and 11 are embedded in a heat resistant electric insulating powder 6 such as magnesia (MgO) contained in the sheath 2.

The above-described second resistive element 11 serves not only as a heating source itself but also as a temperature control means. As the temperature control means, the second resistive element 11 supplies a high electric power to the first resistive element 10 immediately after its energization because it has a small resistance, but subsequently reduces the supply power because the resistance is increased with the lapse of energization time, thereby controlling the saturation temperature of the glow plug to a predetermined temperature or lower and hence preventing overheating. It is apparent that such a function can be realized because the positive resistance temperature coefficient of the second resistive element 11 is large and is gradually increased as heat is generated by energization.

In order to perform optimal current control by means of the second resistive element 11, the first and second resistive elements 10 and 11 are connected to each other such that their helical portions oppose each other through a predetermined gap GAP. More specifically, the predetermined gap is formed between the helical portions of the two resistive elements 10 and 11, and the resistive elements 10 and 11 are connected to each other within the gap through a connecting portion 12 having a small resistance, thereby delaying the thermal influence of the first resistive element 10 on the second resistive element 11, which has posed a problem in the prior art. Consequently, current control by the second resistive element 11 is delayed to prolong the supply time of a high electric power to the first resistive element 10 so as to quickly heat the first resistive element 10 to a red heat state, thus greatly improving the temperature rise characteristic.

According to the present invention, as shown in FIGS. 1 to 3, the temperature self-control type glow plug 1 having the above-described arrangement is characterized in that the outer sheath diameter DR of the tip of the sheath 2, in which the first resistive element 10 as a heating element, is embedded, is set to be smaller than the outer sheath diameter DB of the sheath rear end in which the second resistive element 11 is embedded, the gap GAP (GAP>DR) larger than the sheath diameter DR of the sheath tip in which at least the first resistive element 10 is embedded is formed between the first and second resistive elements 10 and 11, and the two resistive elements 10 and 11 are connected to each other within the gap GAP through the connecting portion 12 having a small resistance, which is constituted by connecting ends (straight end portions 10a and lla) respectively bent from the helical portion ends of the resistive elements 10 and 11 and axially extending therefrom to be located within the small outer diameter of the first resistive element 10. The connecting portion 12 is formed such that its resistance is set to be almost zero.

In the above-described embodiment, a potion of the sheath 2 which corresponds to the above-mentioned gap is constituted by a trumpet-like diameter changing portion, through which a small-diameter portion and a large-diameter portion are coupled to each other.

Figure 4B:
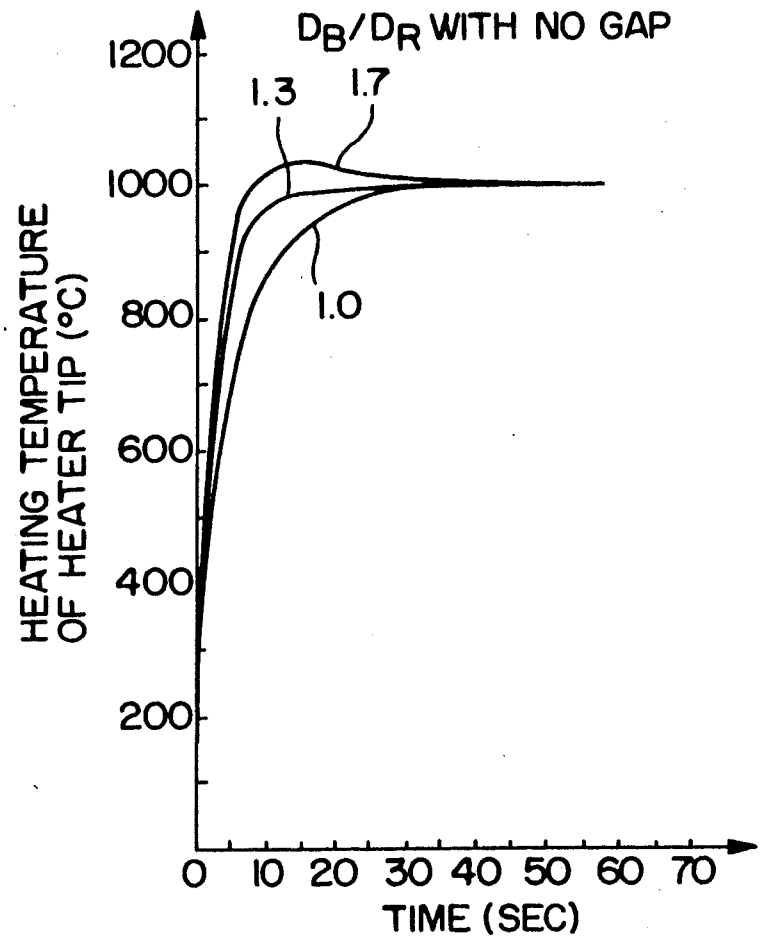
FIGS. 4(*a*) and 4(*b*) are graphs respectively showing the relationships between the time and the heating temperatures of heater tips with and without a gap.
Figure 4A:
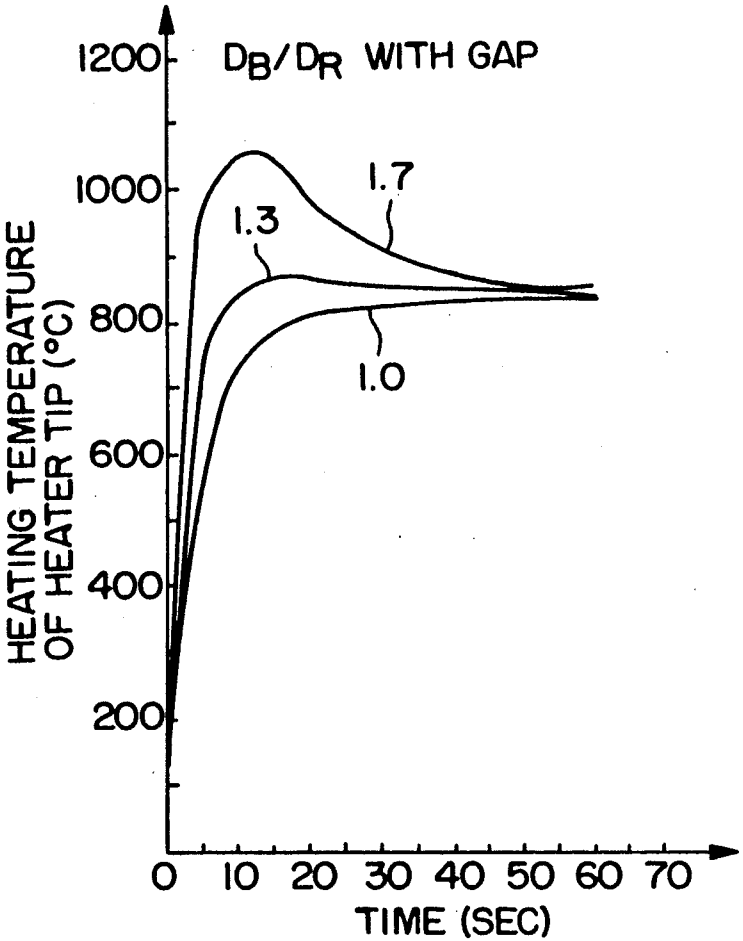

As is apparent from FIGS. 4(*a*) and 4(*b*), it is empirically confirmed that the sheath diameters DR and DB are preferably set to be DB≧1.3 DR, most preferably about {DB/DR=1.7}. For example, if the sheath diameter DB of the rear end of the sheath 2 is 5 mm, the sheath diameter DR of the sheath tip is preferably set to be about 3 mm. FIG. 4(*a*) shows characteristics respectively obtained when DB/DR is set to be 1.0, 1.3, and 1.7 with the gap GAP being fixed to 8 mm. It is confirmed that when the DB/DR is 1.3 or more, an overshoot characteristic can be obtained, and when the ratio is 1.7, the optimal characteristic can be obtained in terms of the peak temperature and manufacture associated with sheath diameter. It is apparent that the quick heating characteristic can be further improved with a higher ratio. However, the sheath tip is narrowed excessively to pose a problem in terms of the manufacture. That is, in consideration of the required thickness of the sheath 2, the wire diameter of the resistive element 10, and the like, it is estimated that a ratio DB/DR of about 2.0 is the limit value in the manufacture. FIG. 4(*b*) shows characteristics obtained when no gap is formed between the first and second resistive elements 10 and 11. Although it is confirmed that when the ratio is about 1.7, a slight overshoot characteristic can be obtained, the obtained characteristic is not sufficient in practice. Therefore, the necessity of the gap GAP in the present invention can be understood. In other words, even if the sheath diameter DR is simply changed to reduce the heat capacity, the required electric power control cannot be properly performed because of the large heat transmission between the two resistive elements 10 and 11.

Figure 5:
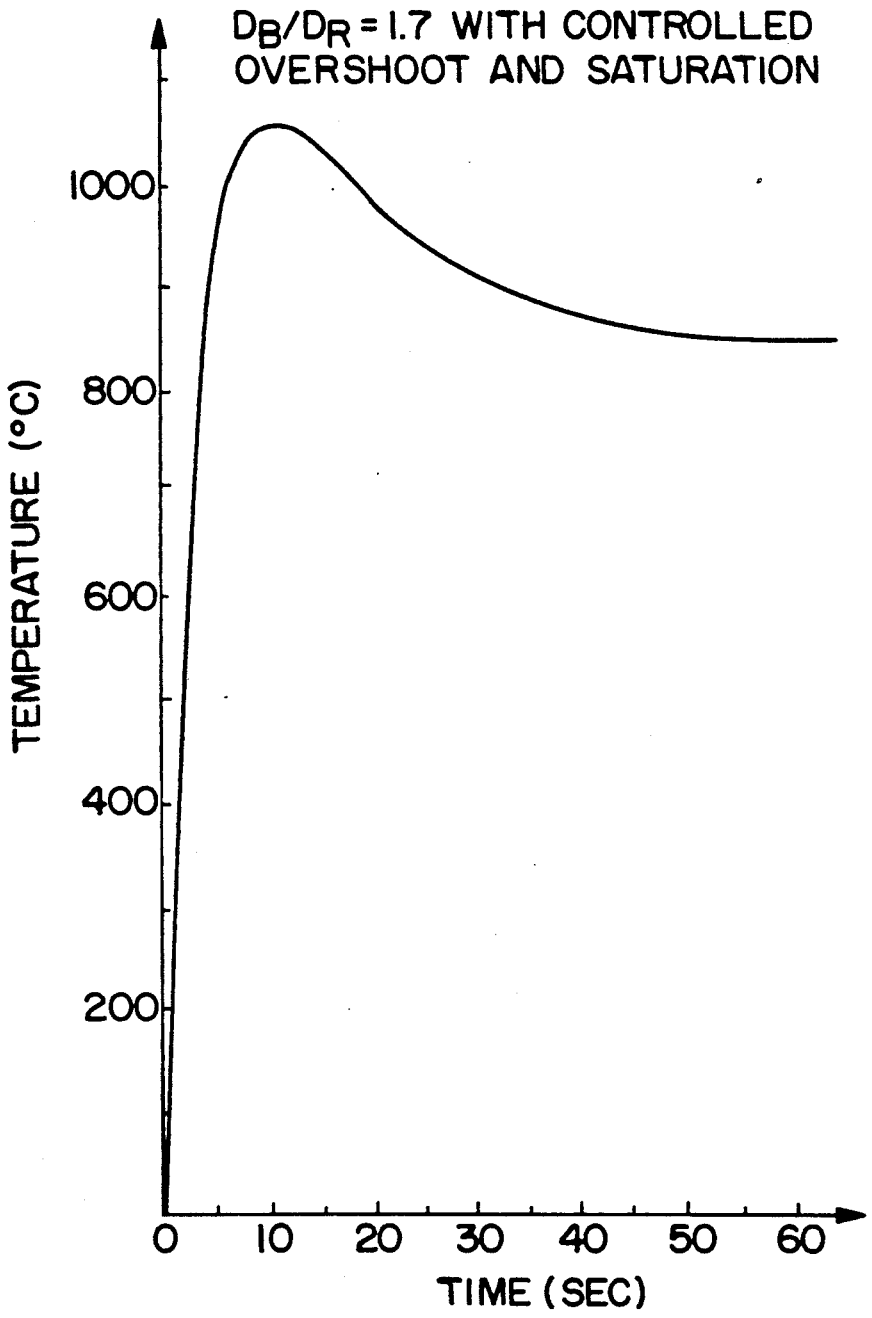
FIG. 5 is a graph for explaining heating characteristics.

According to the above-described arrangement, the heat capacity of the small-diameter portion of the tip of the sheath 2 is set to sufficiently smaller than that of the large-diameter portion of the rear end of the sheath 2 to realize the function of a quick heating type glow type which can quickly achieve red heat and reach a temperature of 800° C. within five seconds. In addition, by properly utilizing the electric power control function by means of the second resistive element 11 on the control side, which is embedded in the rear end of the sheath 2 and connected to the first resistive element 10 in the tip of the sheath 2 through the predetermined gap, the overshoot characteristic shown in FIG. 5 can be obtained, wherein the peak temperature is set to be about 1,050° C., and the saturation temperature can be achieved at a sufficiently low temperature of about 850° C., i.e., lower than the peak temperature by about 200° C., thus allowing afterglow over a long period of time.

According to the above-described sheath heater, when the first and second resistive elements 10 and 11 are to be connected in the predetermined gap GAP through the connection portion, care should be taken over the connecting method using the connecting portion 12 because the portions, of the sheath 2, in which the resistive elements 10 and 11 are embedded have different diameters.

More specifically, the straight end portions 10*a* and 11*a* axially extending from the ends of the helical portions of the first and second resistive elements 10 and 11 are stacked parallelly and connected to each other by laser welding, thus forming the connecting portion 12 having a small resistance (almost zero). The resistive elements 10 and 11 are connected to each other at the connecting portion 12. The two resistive elements 10 and 11 are incorporated in the sheath 2 in the above-described connecting state, and the heat resistance electric insulating power 6 is packed in the sheath 2. Thereafter, a swaging process is performed on the sheath 2 from its outer surface to clamp the heat resistance electric insulating powder 6 in which the resistive elements 10 and 11 incorporated in the sheath 2 are embedded. When, however, the front end of the sheath 2 is narrowed in the swaging process to reduce the diameter of the sheath portion in which the first resistive element 10 is embedded, the connecting portion 12 may move in the gap between the two resistive elements 10 and 11 in the sheath 2 and come into contact with the sheath 2 or the like, resulting in a short circuit or the like.

For example, Japanese Patent Laid-Open Nos. 1-20687 and 1-39015 disclose the simple structure of the connection portion 12 which is used when the two resistive elements 10 and 11 are connected in series with each other within the predetermined gap and incorporated in the sheath 2. According to this structure, the straight portions axially extending from the ends of the helical portions of the resistive elements 10 and 11 are stacked on each other at a position coinciding with the outer diameter of each resistive element. With such a structure, however, it is impossible to completely prevent the connection portion 12 between the resistive elements 10 and 11 from being moved by a pressing force acting on the heat resistance electric insulating powder 6 through the sheath 2 in the above-mentioned swaging process. That is, it is impossible to completely prevent a defective product which is in a short-circuiting state with the connecting portion 12 being in contact with the inner wall of the sheath 2.

For this reason, according to the present invention, the connecting portion 12 through which the resistive elements 10 and 11 are connected to each other is formed to be located within the outer diameter of each of the resistive elements 10 and 11 (the small outer diameter of the first resistive element 10), thereby solving the above-described problems, e.g., a short circuit in the swaging process.

In this embodiment, as is apparent from FIGS. 2(*a*) and 2(*b*), the straight portions 10*a* and 11*a* as the connecting ends extending from the spiral portions of the resistive elements 10 and 11 are bent to extend along substantially the axis of the resistive elements 10 and 11, and are connected to each other by laser welding, thereby forming the connecting portion 12 having a small resistance (almost zero) from the resistive elements 10 and 11.

In this arrangement, since the connecting portion 12 through which the first and second resistive elements 10 and 11 are connected to each other is constituted by the connecting ends extending to be located within the small outer diameter of the first resistive element 10, the problem of a short circuit and the like are not caused when a swaging process is performed on the sheath 2. This always allows formation of a sheath heater in a required state with high reliability, thus solving the problem of quality. In addition, this structure is advantageous in terms of operability in the manufacture.

Furthermore, according to the present invention, since the above-described heating characteristics can be obtained by the glow plug 1 by itself in the self-control scheme, additional circuit components such as a relay for afterglow and a voltage dropping resistor can be omitted, unlike the prior art, thus reducing the overall cost of a preheating device.

Figure 6A:
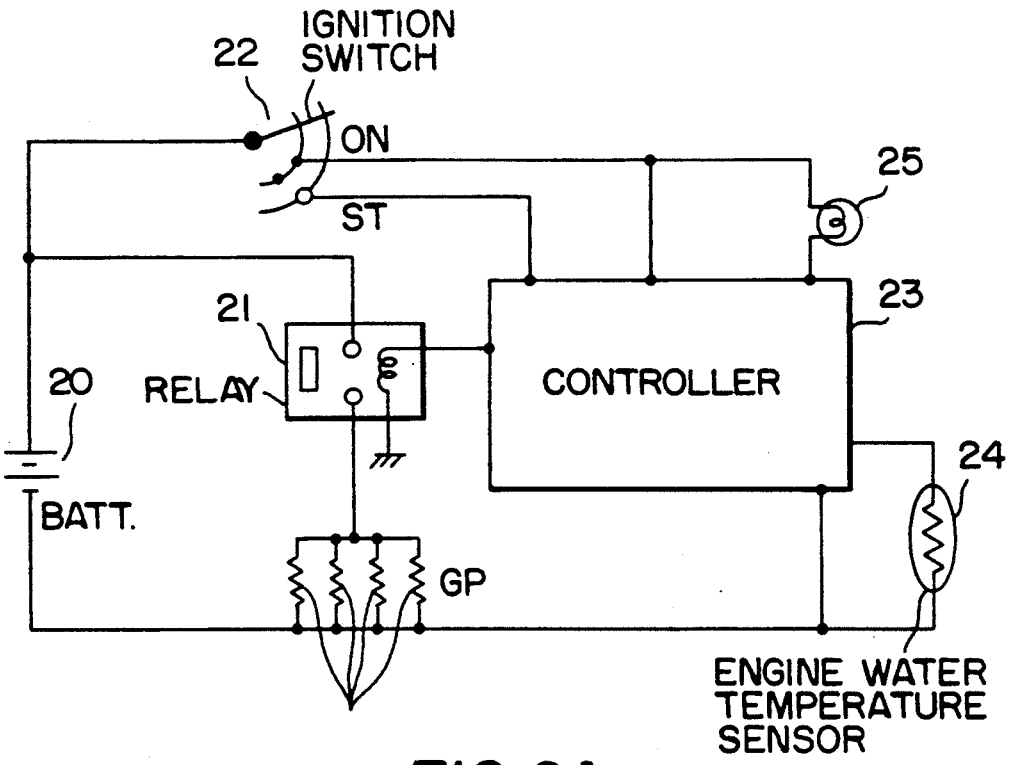
FIGS. 6(*a*) and 6(*b*) are circuit diagrams respectively showing the arrangements of energization circuits for glow plugs according to the present invention and the prior art.
Figure 6B:
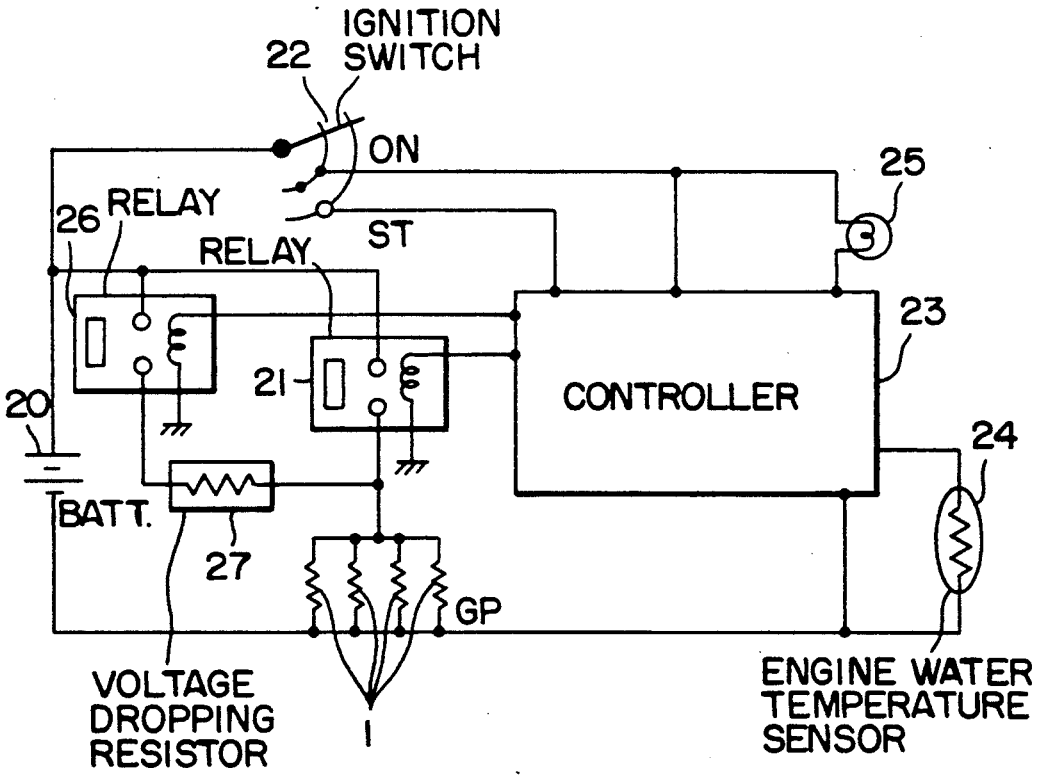
FIG. 6B PRIOR ART

The arrangement of an energization circuit for the above-described glow plug 1 will be briefly described below with reference to FIG. 6(*a*). In this arrangement, the heater portions of four glow plugs 1 (GP) are connected in parallel, and a rated voltage from a battery power source 20 of, e.g., 12 V is applied to each heater portion through a relay 21 to cause each heater portion to generate heat, so that the combustion chamber or sub-combustion chamber of a diesel engine is preheated to enhance the starting characteristic of the engine. Note that each glow plug 1 described above is grounded to the vehicle body. In addition, reference numeral 22 denotes an ignition switch 23, a controller having a timer function; 24, an engine cooling water temperature sensor; and 25, a start timing display unit. Since the operations and the like of these components are known, a detailed description thereof will be omitted.

According to the glow plug 1 of the present invention, the above-described circuit arrangement can be employed because of its temperature self-control function. In the conventional glow plug, however, as shown in FIG. 6(*b*), another circuit must be arranged as a control circuit for afterglow, which requires a control relay 26 and a voltage dropping resistor 27 as additional components. The difference between these two circuit arrangements is easily understood.

The present invention is not limited to the structure of the embodiment described above. For example, the shape and structure of each component of the glow plug 1 can be properly modified and changed, and hence various modifications can be made. In the above embodiment, the straight end portions 10*a* and 11*a* extending from the ends of the helical portions of the resistive elements 10 and 11 along the axis are stacked on each other on the axis and welded. However, the present invention is not limited to this. For example, the connection portion 12 may extend obliquely. That is, it is essential that the two resistive elements 10 and 11 are connected to each other through the connection portion 12 having a sufficiently small resistance and extending to be located within the outer diameter of the resistive element having a smaller diameter. In addition, it is apparent that the connecting portion 12 is not limited to the one formed by connecting the connecting ends extending from the two resistive elements, but a connection portion formed by connecting the connection end extending from one resistive element to the connecting end at the end of the spiral portion of the other resistive element can be used.

As has been described above, the temperature self-control type glow plug according to the present invention comprises the first helical resistive element serving as a heating element, the second helical resistive element connected in series with one end of the first resistive element and having a positive resistance temperature coefficient larger than that of the first resistive element, and the sheath enclosing the first and second resistive elements embedded in the heat resistance electric insulating powder. The diameter of the sheath portion in which the first resistive element is embedded is set to be smaller than that of the sheath portion in which the second resistive element is embedded, and the pag larger than at least the diameter of the sheath portion in which the first resistive element is embedded is formed between the first and second resistive elements. In addition, the two resistive elements are connected to each other within the gap through the connection portion having a small resistance, which is constituted by the connecting ends extending from the two resistive elements to be located within the outer diameter of the first resistive element. Therefore, in spite of such a simple arrangement, the heat capacity of the sheath tip in which the first resistive element serving as a heating element is embedded can be sufficiently reduced to allow a quick heating operation at the initial stage of energization, thus realiz ing the quick heating function. In addition, by properly utilizing the electric power control function by means of the second resistive element located on the control side, i.e., on the rear side of the sheath, and connected to the first resistive element on the front side of the sheath through the predetermined gap, the overshoot characteristic can be obtained, wherein the heating temperature can be decreased to a saturation temperature sufficiently lower than the peak temperature with the lapse of time, thus allowing afterglow over a long period of time. Furthermore, since such heating characteristics can be obtained by the glow plug by itself, no additional circuit components are required. Since the connecting portion through which the first and second resistive elements are connected to each other is constituted by the connecting ends extending to be located within the small outer diameter of the first resistive element, the problem of short circuit and the like are not caused when a swaging process is performed on the sheath. This allows formation of a sheath heater in a required state with high reliability, thus improving the overall operability in the manufacture and achieving a reduction in manufacturing cost.

What is claimed is:

1. A temperature self-control type glow plug comprising:

a first helical resistive element serving as a heating element;

a second helical resistive element connected in series with one end of said first helical resistive element and made of a material having a positive resistance temperature coefficient larger than that of said first helical resistive element;

a metallic sheath enclosing said first and second helical resistive elements in an end to end relationship, said first and second helical resistive elements embedded in a heat resistant electric insulating powder, wherein an outer sheath diameter DR of a portion of said sheath in which said first helical resistive element is embedded is set to be smaller than an outer sheath diameter DB of a portion of said sheath in which said second helical resistive element is embedded, a gap larger than the sheath diameter DR of the portion in which said first helical resistive element is embedded formed between ends of said first and second helical resistive elements, and said two helical resistive elements connected to each other within the gap through connecting ends respectively extending from said resistive elements, said connecting ends located within an outer diameter of said first helical resistive element.

2. A glow plug according to claim 1, wherein the sheath diameters are set to satisfy $DB \leqq 1.3\ DR$.

3. A glow plug according to claim 1, wherein a sheath diameter ratio is set to be $DB/DR = 1.7$.

4. A glow plug according to claim 1, wherein the connecting ends in the gap between said first and second helical resistive elements are straight and are connected in parallel by welding.

5. A glow plug according to claim 1, wherein the outer diameter of said first helical resistive element is smaller than an outer diameter of said second helical resistive element.

* * * * *

UNITED STATES PATENT AND TRADEMARK OFFICE

CERTIFICATE OF CORRECTION

PATENT NO. : 5,206,483

DATED : April 27, 1993

INVENTOR(S) : Aota

It is certified that error appears in the above-identified patent and that said Letters Patent is hereby corrected as shown below:

In column 1 at line 8 change "particu" to --particularly--;

In column 1 at line 12 change "used o improve" to --used to improve--.

Signed and Sealed this

Nineteenth Day of September, 1995

*Attest:*

*Attesting Officer*

Bruce Lehman

BRUCE LEHMAN

*Commissioner of Patents and Trademarks*